US005979500A

United States Patent [19]

Jahrling et al.

[11] Patent Number: 5,979,500

[45] Date of Patent: Nov. 9, 1999

[54] DURATION-INDICATING AUTOMATIC FAUCET

[75] Inventors: Peter J. Jahrling, Park Ridge, Ill.; Natan E. Parsons, Brookline, Mass.

[73] Assignees: Arichel Technologies, Inc., West Newton, Mass.; Sloan Valve Co., Franklin Park, Ill.

[21] Appl. No.: 09/233,276

[22] Filed: Jan. 19, 1999

[51] Int. Cl.[6] ..... F16K 51/00

[52] U.S. Cl. ..... 137/624.12; 251/129.04; 4/623

[58] Field of Search ..... 137/624.11, 624.12; 251/129.04; 4/623

[56] References Cited

U.S. PATENT DOCUMENTS

| | | | |
|---|---|---|---|
| 3,576,277 | 4/1971 | Blackmon | 4/623 X |
| 3,639,920 | 2/1972 | Griffin et al. . | |
| 4,606,085 | 8/1986 | Davies | 4/623 |
| 5,202,666 | 4/1993 | Knippscheer | 4/623 X |

*Primary Examiner*—Kevin Lee
*Attorney, Agent, or Firm*—Cesari and McKenna, LLP

[57] ABSTRACT

In an automatic-faucet system, the control circuit that operates the system's valve (18) causes an indicator lamp (32) to start blinking when it first opens the valve. It keeps the lamp blinking for a predetermined duration to indicate to the user that a time interval prescribed as necessary for effective hand washing has not yet expired. When the interval does expire, the user is thereby assured that he has complied with the relevant duration regulation.

6 Claims, 7 Drawing Sheets

DURATION-INDICATING AUTOMATIC FAUCET

BACKGROUND OF THE INVENTION

The present invention is directed to automatic flow-control systems. It applies particularly to automatic faucets.

The human hand functions disproportionately as a disease carrier. But the hand's propensity to transmit disease can be largely suppressed simply by effective hand washing. This fact is well known to public-health authorities, who have accordingly expended considerable effort in promulgating regulations and information to encourage the public, and food workers in particular, to exercise proper hygiene in this regard. Prominent among such efforts is the posting of signs in food workers' rest rooms that urge workers to wash their hands.

Such personnel should not just wash their hands but also do it effectively. To a great extent the effectiveness depends on the washing operation's duration, so efforts have additionally been made to sensitize food workers in particular to the desirability of is observing a minimum hand-washing duration.

While these efforts have undoubtedly produced a higher public-health level, considerable room for improvement remains. Human behavior being a central factor, compliance can be spotty.

SUMMARY OF THE INVENTION

We have recognized that a simple expedient can aid in increasing compliance, at least in automatic-faucet environments. In an automatic-faucet system, a control circuit opens the faucet valve in response to an object sensor's detecting an object such as a human hand that meets predetermined criteria. We provide a flashing light or other human-detectable indicator that we have the control circuit begin operating when the faucet valve opens, and we have the control circuit keep the indicator in operation for the recommended hand-washing duration. In that way the user is reminded to keep washing until the recommended washing duration has elapsed. This simple device improves compliance significantly.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
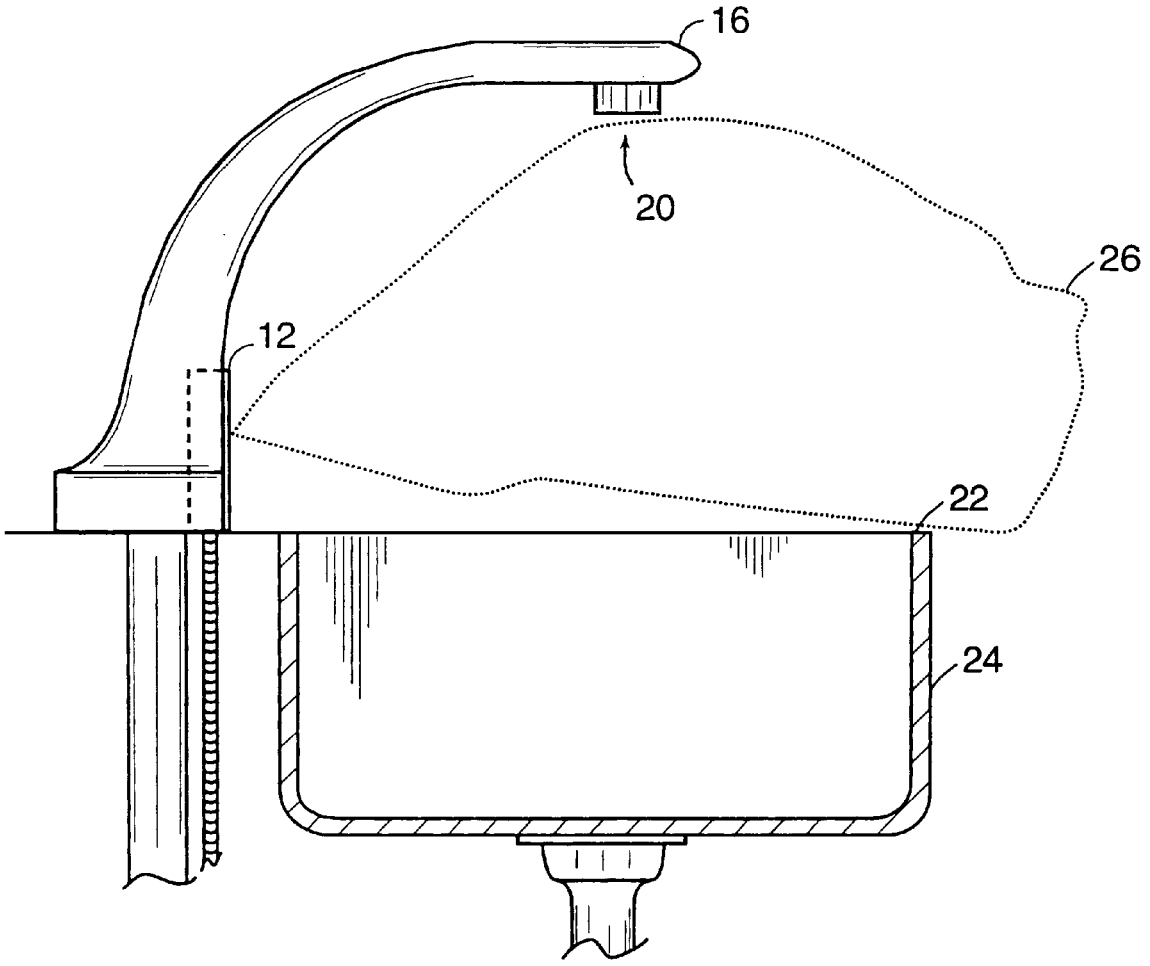
FIG. 1 is a side elevational view of an automatic-faucet system that employs the present invention's teachings.
Figure 2:
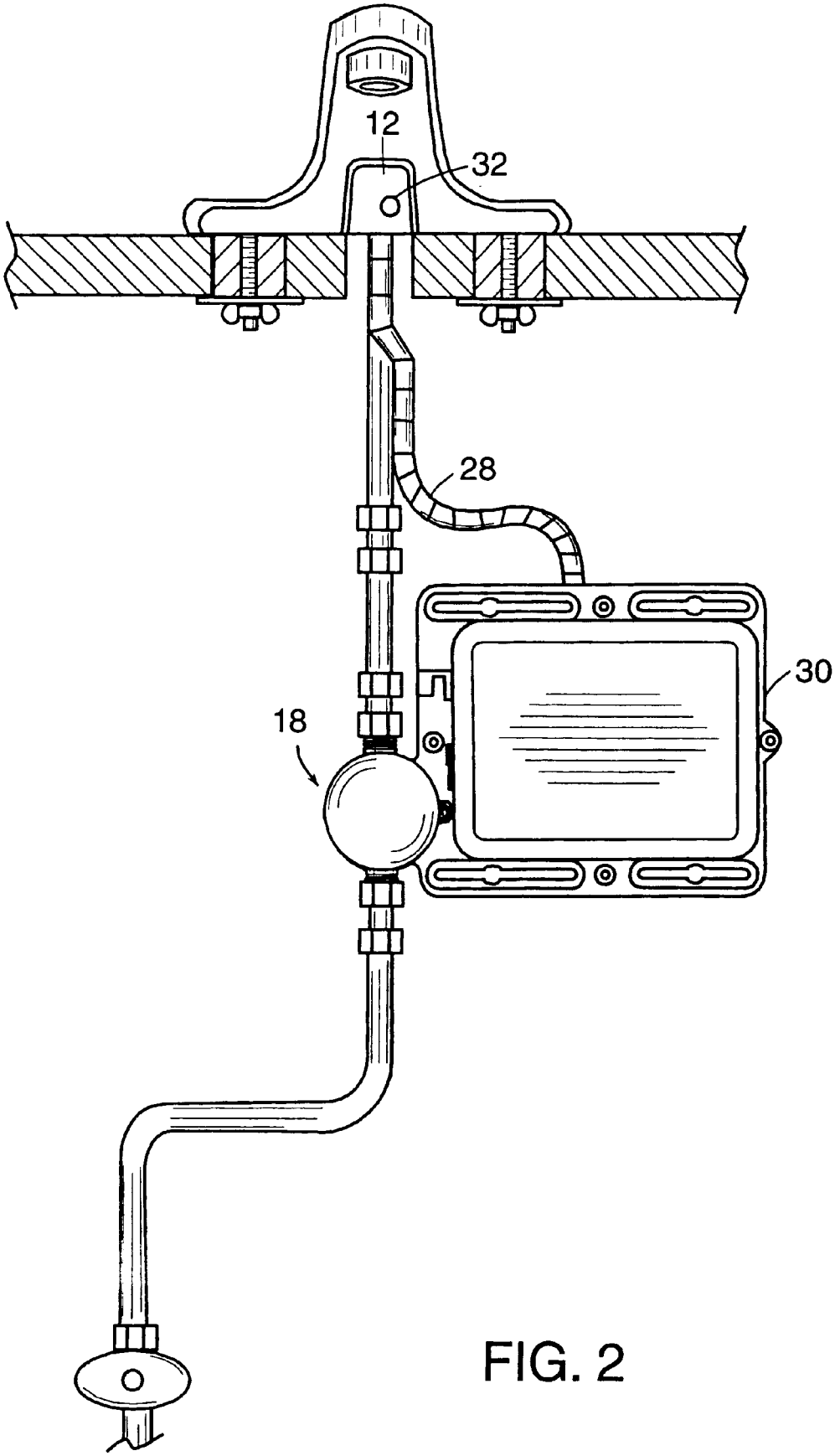
FIG. 2 is a side elevational view of the FIG. 1 system with the sink removed.

FIGS. 1 and 2 depict a typical installation in which the present invention's teachings can be employed. The infrared-radiation sensor assembly 12 to which a control circuit responds in controlling an automatic faucet 16's electromechanical valve 18 (FIG. 2) responds to objects located between the faucet's outlet 20 and the lip 22 of a sink 24 that receives water flowing from the outlet. The sensor forms a far-field pattern that dashed-curve 26 depicts. The system tends to detect objects in the dashed-curve region and ignore those outside it.

The illustrated embodiment's infrared sensor is of the active variety: it shines infrared radiation into a target region and bases its presence determinations on resultant reflections. The present invention's teachings can also be implemented in "passive" infrared systems. Such systems do not shine radiation into the target region. They base their determinations on radiation that objects emit or reflect naturally. Indeed, the present invention can be practiced without using an infrared sensor at all. Other types are also suitable. One example is the ultrasonic variety which detects objects by transmitting ultrasound into the target region and sensing any resultant echo.

If the detected object meets certain criteria—which will differ in different embodiments—the control circuit opens the valve. In battery-operated systems, the valve is preferably of the latching variety, which requires no power to remain open or closed; it requires power only to switch between its open and closed states.

The control circuit may then operate the valve to its closed position after a fixed predetermined duration. Or it may close the valve when the sensor no longer detects a target meeting certain criteria. In the latter operational mode, there is usually a predetermined maximum flow duration after which the control system closes the valve even if a target meeting those criteria is still present.

FIG. 2 shows that in the illustrated embodiment a cable 28 runs from the sensor assembly 12 to a remote part 30 of the control circuit, which is electrically connected to the valve 18's actuating solenoid. Cable 28 additionally conducts signals from the control circuit 30 to a visible-light-emitting diode (LED) 32, which the control circuit operates without regard to any object-qualifying criteria. The control circuit may operate the LED 32 in response to object detection during initial installation to help installation personnel determine the location of the object sensor's sensitive region. If the control circuit is powered by batteries in its remote part 30, it may additionally cause the LED 32 to illuminate if batteries run low.

The control circuit may use the LED for other purposes, too. In accordance with the present invention, though, the control circuit at some point enters a mode in which it additionally so operates the LED 32 as to encourage the user to keep washing his hands until a predetermined hand-washing interval has been completed. The faucet may operate in conjunction with a soap dispenser, for instance, and enter this mode when a dose of soap has been dispensed.

Figure 3:
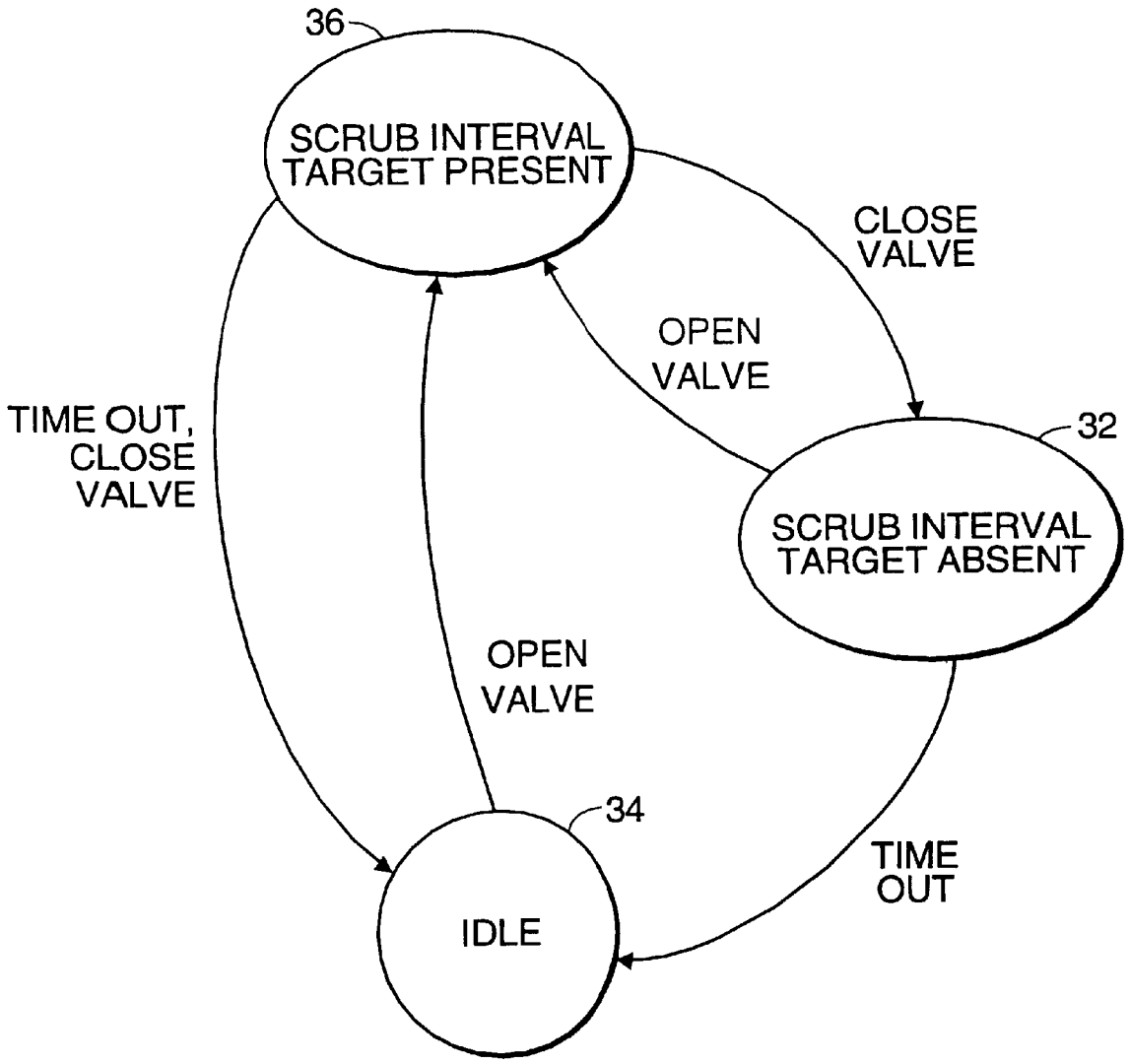
FIG. 3 is a state-transition diagram that illustrates the present invention's operation.

FIG. 3 depicts this mode in a simplified manner. When there has been no activity for a while, the process is in an idle state 34, in which the LED is not energized. The process assumes a target-present state 36, and begins a timer, when the control system opens the valve 18 in response to the sensor's detection of a target meeting appropriate criteria. (What these criteria are is not of importance to the present invention and will likely vary from embodiment to embodiment.) Assumption of this state causes a timer in the control circuit to begin timing a predetermined-duration hand-washing interval, during which the control circuit causes the LED 32 to flash and thereby inform the user that the prescribed interval has not been completed.

The process leaves the target-present state 36 either when the timer reaches a count representing the predetermined interval or when the valve closes in response to the user's removing his hands, whichever occurs first. In the former case, the valve closes and the process returns to the idle state. In the latter case, the valve closes and process assumes the target-absent state 38. It opens the valve and returns to the target present state if it detects a target before the timer times out. Otherwise, it returns to the idle state 34 when the timer reaches the predetermined count.

Of course, the human-perceptible indicator does not have to flash. Indeed, it does not need to be a lamp or even a visual indicator of any kind. It can instead be buzzer, for instance. Also, some of the invention's embodiments may not cause the indicator's active operation unless the valve closes too soon; e.g., the LED may not flash unless the system assumes the incomplete-duration state 40.

As was stated above, FIG. 3 depicts the control circuit's behavior in a simplified manner. FIGS. 4A–D depict it in more detail. The system's control circuit includes a processor-interrupt timer that causes a control-circuit processor to "wake up" every 100 msec. and perform the procedure that FIGS. 4A–D depict. Block 50 represents the occurrence of an interrupt that causes that procedure to begin. After a number of initialization operations and other steps not relevant to the present invention's operation, the processor operates the infrared object sensor, as block 52 indicates, and sets a flag that indicates whether it has detected a target meeting predetermined criteria. Decision block 54 represents branching on this flag's value.

To reduce the effects of spurious detections, the process does not respond to the first target detection that occurs. Instead, as blocks 56, 58, and 60 indicate, it increments a detection count and then tests whether that detection count exceeds 3. If it does not, the routine ends, to be started again when the interrupt timer again times out, 100 msec. later. As blocks 62, 64, and 60 indicate, the routine similarly ignores isolated absences of a detected target: it is only after three cycles in which detection has not occurred that the process proceeds to respond. If the detection count does exceed 3, then the routine re-sets the detection count and sets a valid-target flag, as blocks 66 and 68 indicate.

As decision block 70 indicates, what happens next depends on whether the valve is already open when the system detects a valid target. The illustrated embodiment is designed to prevent the valve from opening unless there has been target absence for at least 1.5 sec. in a row since the valve closed. A mandatory-closure flag is used to enforce this rule. If the valve is closed, therefore, the routine tests this flag to ensure that it has not been set. Block 71 represent this step. If the flag has been set, the target detection has interrupted the 1.5-second interval, so the count that measures that interval must be reset, as block 72 indicates. As block 73 indicates, the routine then ends. If the flag has been set, the routine sets a flash flag, as block 74 indicates. So long as the flash flag is set, the scrub-duration LED keeps flashing. As blocks 76 and 78 indicate, the routine then opens the valve and starts a timer that indicates how long the valve has been open. Block 80 indicates that the routine then ends.

If the valve was already open in a cycle in which a valid target is recognized, the process checks the open timer, as block 84 indicates, to determine whether that timer has already reached the prescribed scrub-timer duration. If so, the process sets a time-out flag. As blocks 86 and 80 indicate, the control circuit simply "goes to sleep" if the timeout is not thereby set. Otherwise, the mandatory-closure flag is set, as block 88 indicates, to show that the valve should not be opened again until 1.5 seconds of target absence occurs. Block 88 represents this step. The close-time count and open timer are then reset and the flash flag cleared, as blocks 89, 90 and 92 indicate. As blocks 94 and 80 indicate, the valve is then closed and the current wake period ends.

Figure 4A:
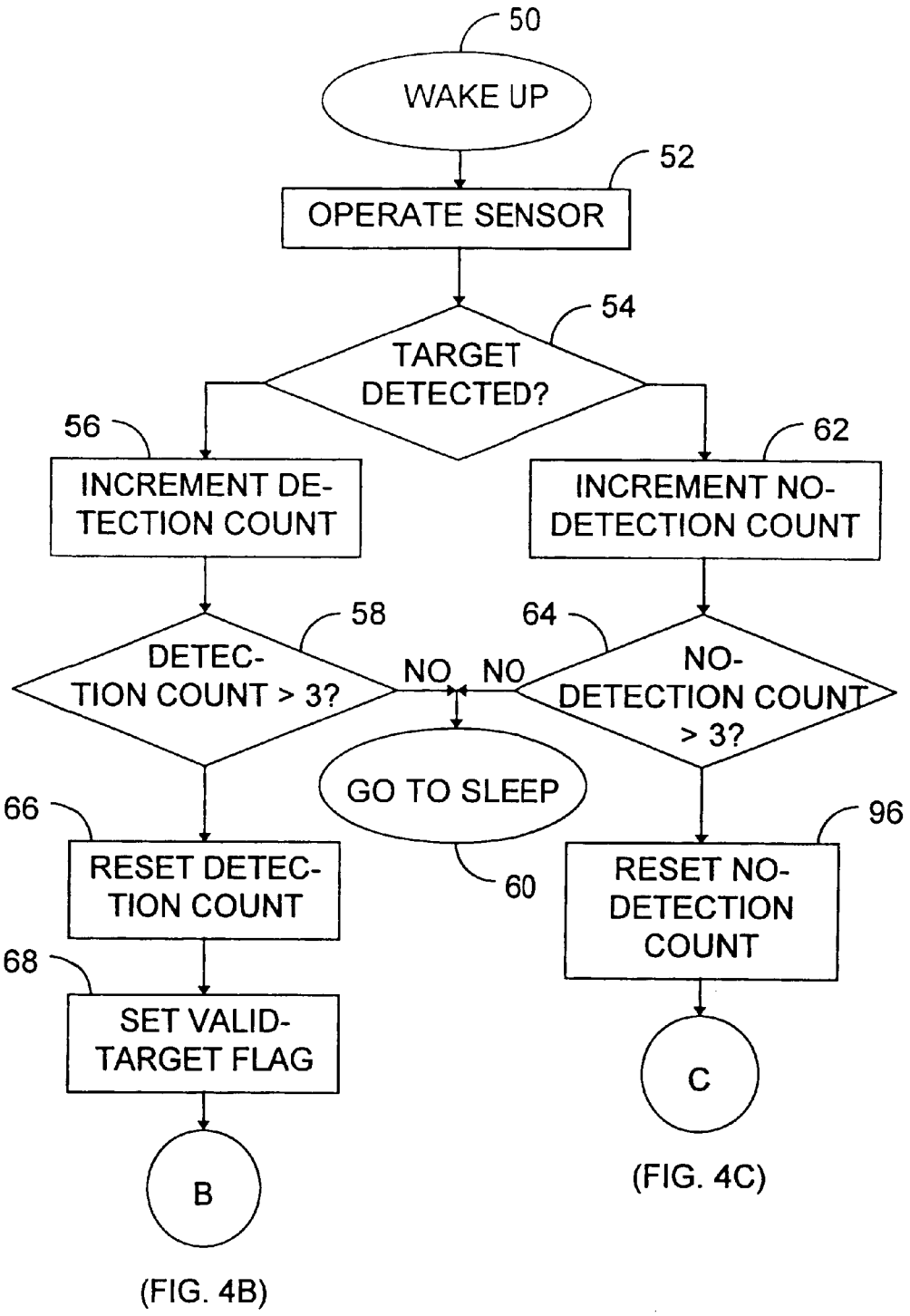
FIG. 4A–D together form a flow chart of a procedure that the faucet system's control circuit performs to implement the state-transition diagram of FIG. 3.
Figure 4B:
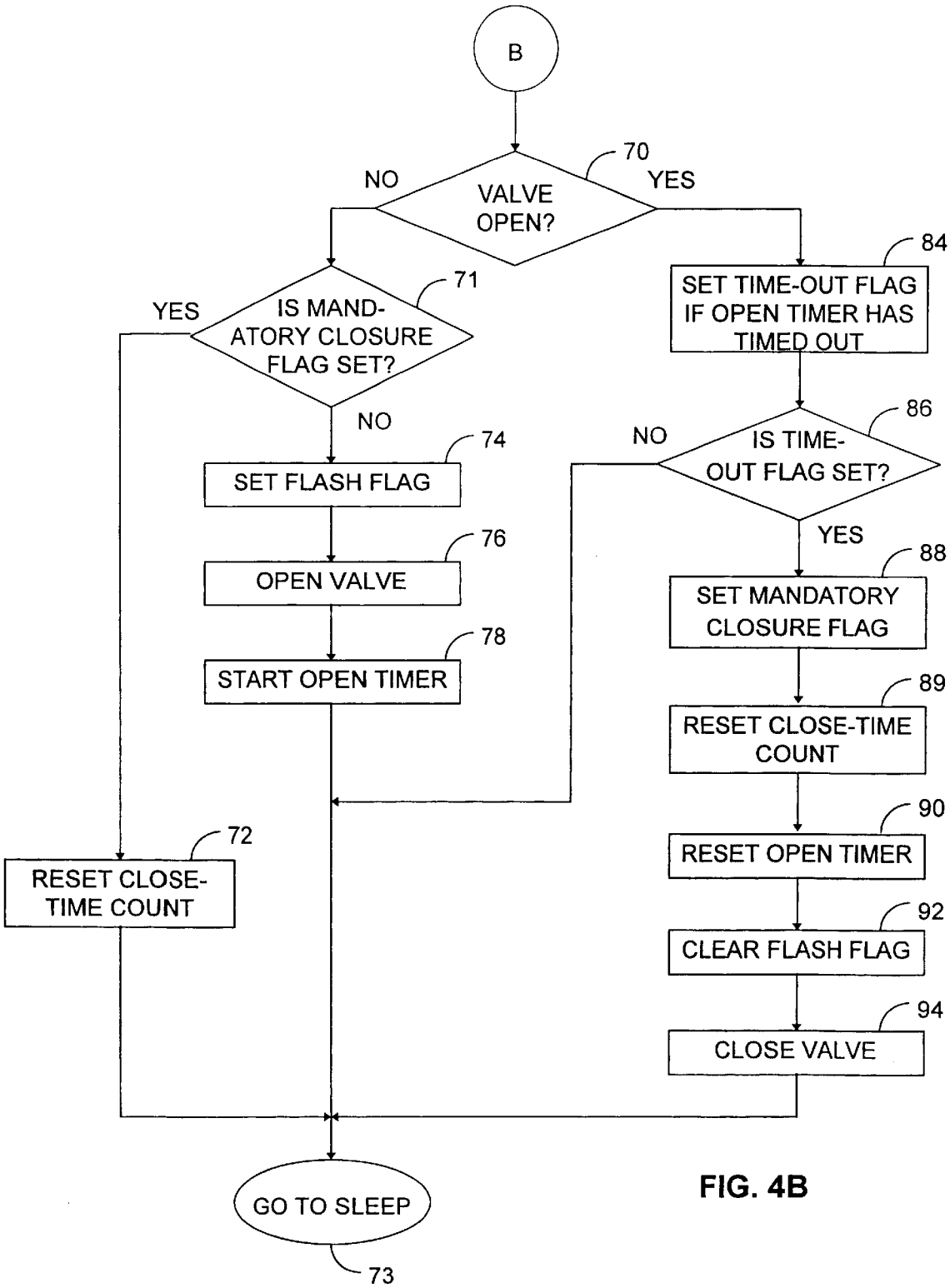
Figure 4C:
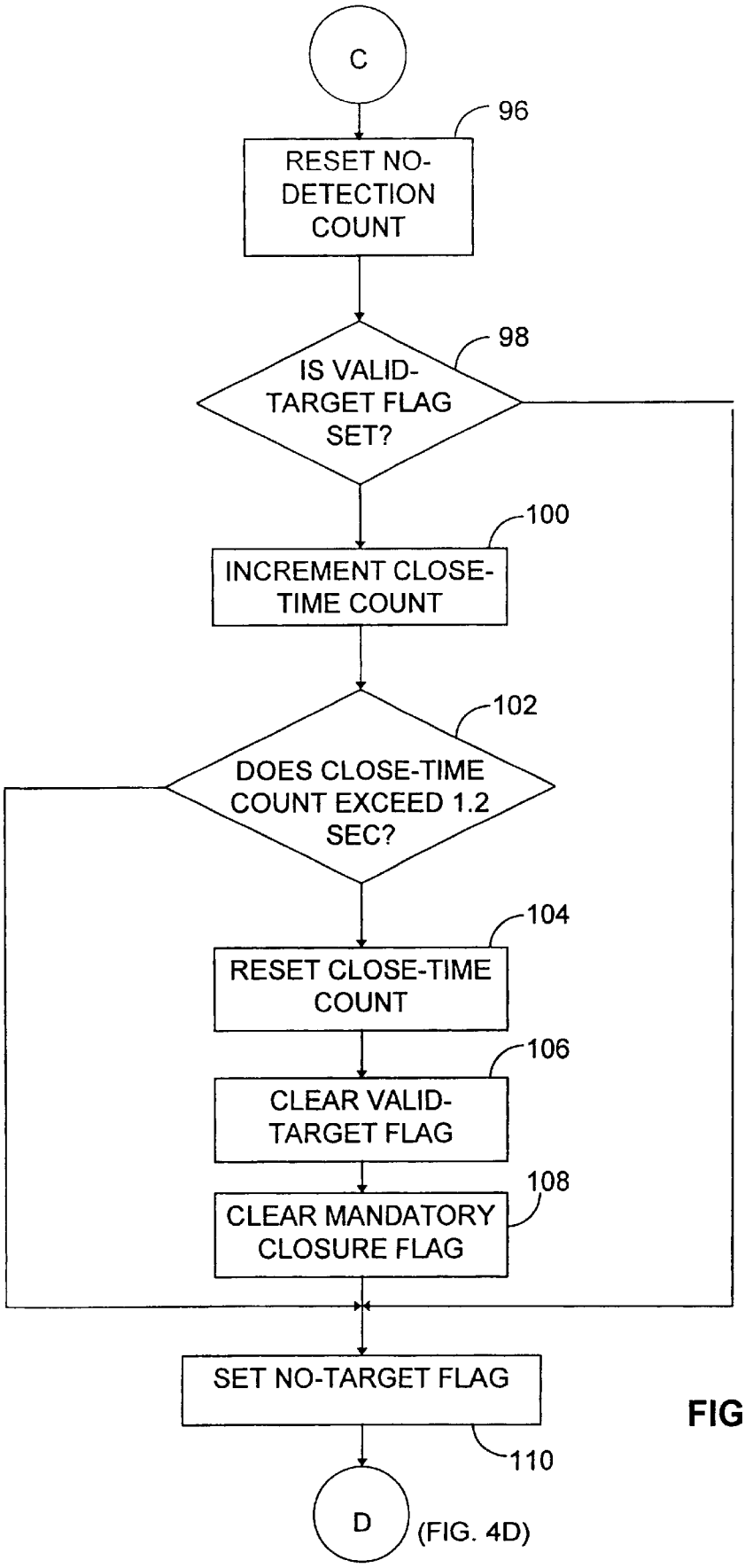
Figure 4D:
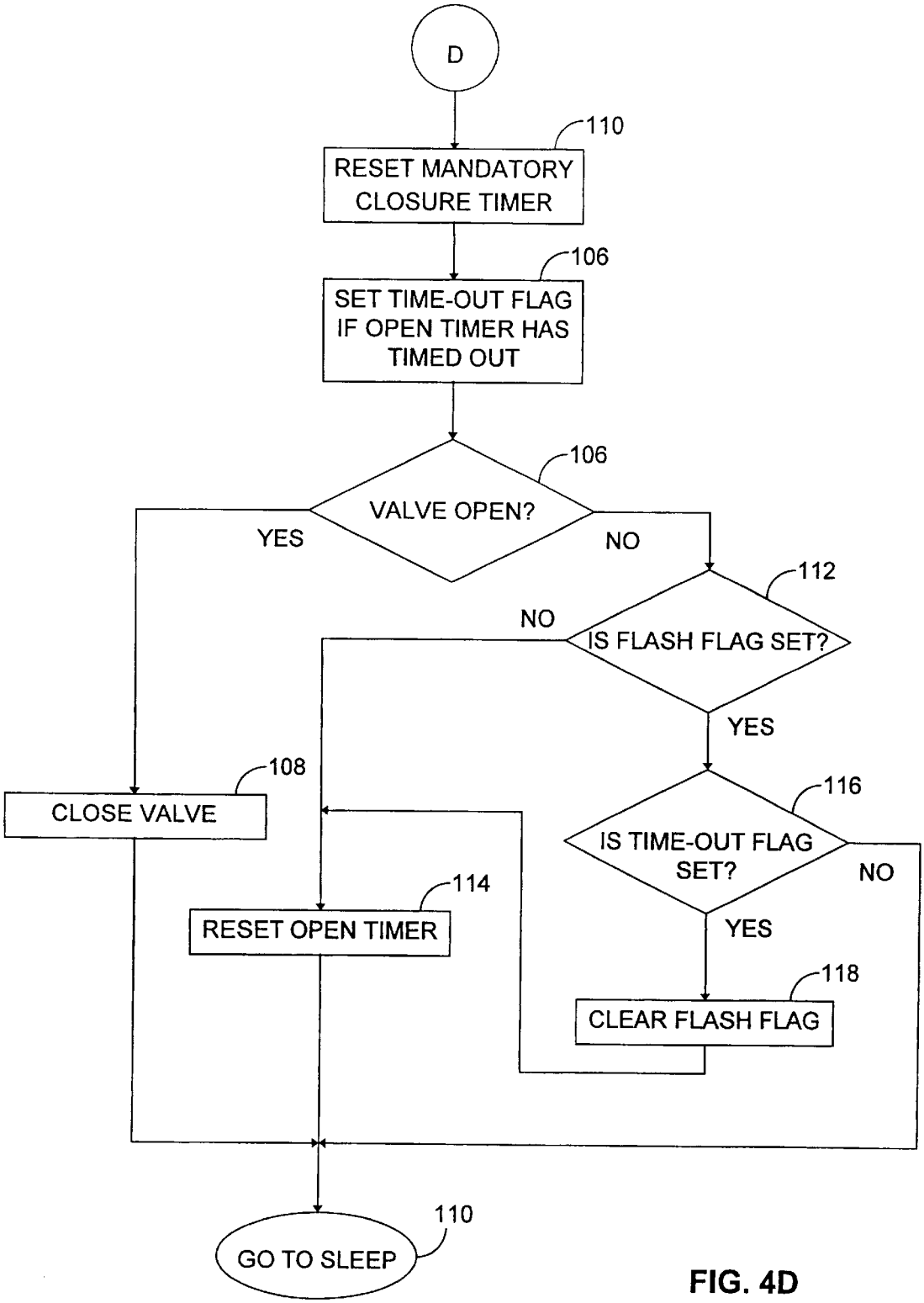

We now return to the behavior that the procedure exhibits when the sensor does not detect a target meeting the prescribed criteria. FIG. 4A's block 96 shows that the fourth target absence in a row results in the no-detection count's being reset. The process then proceeds with FIG. 4C's step 98, in which the procedure tests the valid-target flag to determine whether a valid target has recently been present. If so, the process must determine whether the mandatory-closure duration has elapsed since that valid target. To this end, it increments the close-time count, as block 100 indicates, and then tests that count to determine whether its value corresponds to a duration greater than 1.5 seconds. Block 102 represents this test. If that test indicates that this mandatory-closure duration has been reached, then the close-time count is reset, as block 104 indicates. As block 106 indicates, the process then clears the valid-target flag. As block 108 indicates, the process also clears the mandatory-closure flag so that the valve can be opened in response to any subsequent valid target detection.

As block 110 indicates, the process sets a no-target flag without regard to whether the valid-target flag had been set or the close-time count has reached the mandatory-closure duration. The process then proceeds to service the scrub-duration timer: if it has timed out, the process sets the time-out flag. If the valve is open, the procedure then causes it to be closed, as blocks 106 and 108 indicate, and the processor returns to its sleep state, as block 110 indicates, until the next periodic interruption.

If the valve is already closed, on the other hand, a test represented by block 112 determines whether the flash flag is set. If not, the scrub-duration timer is cleared, as block 114 indicates, and the procedure's current cycle ends. Otherwise, the cycle simply ends without further operations if the time-out flag is not set, as block 116 indicates. If the time-out flag is set, then the flash flag is cleared and the scrub time reset, as blocks 118 and 114 indicate.

Although we have described the invention in terms of a flashing light, it is apparent that the present invention's teachings can be practiced by embodiments that use any other visible, audible, or other humanly detectable indication that the scrub time has not been completed. The invention can thus be practiced in a wide range of embodiments and accordingly constitutes a significant advance in the art.

What is claimed is:

1. An object-sensor-based flow-control system comprising:

A) a fluid conduit having an inlet and an outlet;

B) an electromechanical valve interposed in the conduit and operable by application of control signals thereto to switch between an open state, in which the electromechanical valve permits fluid flow through the conduit, and a closed state, in which the electromechanical valve prevents fluid flow through the conduit;

C) an object sensor for detecting objects in a target region and generating sensor output signals in response thereto;

D) an incomplete-interval indicator operable by application of control signals thereto to generate a human-perceptible indication that a predetermined interval has not been completed; and E) a control circuit that, in response to the sensor signal's indicating an object's presence under predetermined interval-commencement conditions:

i) applies control signals to the electromechanical valve that operate the valve to its open state; and ii) begins a timing interval that lasts for predetermined duration, during which the control circuit applies, to the incomplete-interval indicator, signals that cause the incomplete-interval indicator to generate the human-perceptible indication.

2. An object-sensor-based control system as defined in claim 1 wherein the control circuit begins a timing interval only if no previous timing interval is incomplete.

3. An object-sensor-based control system as defined in claim 1 wherein the object sensor includes an infrared object detector.

4. An object-sensor-based control system as defined in claim 3 wherein the infrared object detector is an active infrared object detector.

5. An object-sensor-based control system as defined in claim 4 wherein the infrared object detector is a passive infrared object detector.

6. An object-sensor-based control system as defined in claim 1 wherein the object sensor includes an ultrasonic object detector.

* * * * *